US006428208B1

(12) United States Patent
Addison et al.

(10) Patent No.: US 6,428,208 B1
(45) Date of Patent: Aug. 6, 2002

(54) INTERNAL PROFILE HANGER WITH OUTWARDLY PROJECTING TAB MEMBER WITH INFORMATIONAL INDICIA THEREON

(75) Inventors: Todd M. Addison, Greenwich, CT (US); Alfred Salerno, Sea Cliff, NY (US)

(73) Assignee: Ultra Flex Packaging Corporation, Brooklyn, NY (US)

( * ) Notice: Subject to any disclaimer, the term of this patent is extended or adjusted under 35 U.S.C. 154(b) by 0 days.

(21) Appl. No.: 09/714,596

(22) Filed: Nov. 16, 2000

Related U.S. Application Data

(63) Continuation-in-part of application No. 09/521,455, filed on Mar. 8, 2000, now Pat. No. 6,186,934.

(51) Int. Cl.[7] ..... B65D 33/14

(52) U.S. Cl. ..... 383/23; 40/322; 206/287; 383/27

(58) Field of Search ..... 383/23, 27; 40/322; 206/288, 286, 287, 287.1

(56) References Cited

U.S. PATENT DOCUMENTS

| | | | | |
|---|---|---|---|---|
| 2,400,406 A | | 5/1946 | Godoy | 229/79 |
| 2,439,584 A | | 4/1948 | Shumann | 229/62 |
| 3,065,946 A | | 11/1962 | Berkow | 248/317 |
| 3,098,561 A | * | 7/1963 | Kass | 206/287 |
| 3,132,742 A | * | 5/1964 | Shapiro et al. | 206/278 |
| 3,231,901 A | | 2/1966 | Kennedy | 4/110 |
| 3,429,498 A | | 2/1969 | Dorfman | 229/54 |
| 3,452,922 A | | 7/1969 | Hart | 229/54 |
| 3,462,068 A | | 8/1969 | Suominen | 229/54 |
| 3,525,468 A | | 8/1970 | Kamins et al. | 229/54 |
| 3,549,085 A | | 12/1970 | Hart | 229/54 |
| 3,670,947 A | | 6/1972 | Tangredi et al. | 229/54 R |
| 3,672,562 A | | 6/1972 | Bosse | 229/54 C |
| 3,693,867 A | | 9/1972 | Schwarzkopf | 229/54 R |
| 3,695,418 A | | 10/1972 | Gwozdz | 206/45.33 |
| 3,720,036 A | | 3/1973 | Armstrong | 53/14 |

(List continued on next page.)

FOREIGN PATENT DOCUMENTS

| | | |
|---|---|---|
| EP | 0 454 521 A1 | 10/1991 |
| FR | 1404575 | 5/1965 |
| FR | 2 530 223 | 3/1984 |
| GB | 2 074 985 A | 11/1981 |
| GB | 2 111 459 A | 6/1983 |
| WO | WO 94/01334 | 1/1994 |

OTHER PUBLICATIONS

"Concepts in vertical merchandising and specialty packaging", W. R. Grace & Co., 1971, 102 pages.
"Hanes pack redesign makes shopping simpler", Packaging World, Oct. 1999, p. 11.

*Primary Examiner*—Stephen P. Garbe
(74) *Attorney, Agent, or Firm*—Perman & Green, LLP

(57) ABSTRACT

A package is formed from two sheets of thin film material which are double backed upon each other to form a header portion and a substantially rigid insert is connected to the header portion coincident with a cutout formed therein. The cutout exposes an internalized J-shaped portion of the insert defining a hook by reason of which the package can be readily attached to, maintained on, and removed from a display rack. The insert includes a tab member which projects beyond a leading edge of the package and defines highly visible opposed surfaces for reception thereon of informational indicia.

18 Claims, 10 Drawing Sheets

U.S. PATENT DOCUMENTS

| | | | | |
|---|---|---|---|---|
| 3,765,597 | A | | 10/1973 | Brieske ..... 229/62 |
| 3,782,622 | A | | 1/1974 | Montgomery ..... 229/54 R |
| 3,836,068 | A | | 9/1974 | Schwarzkopf ..... 229/54 R |
| 4,084,689 | A | | 4/1978 | Yamagata ..... 206/280 |
| 4,153,560 | A | | 5/1979 | Dinter et al. ..... 250/531 |
| 4,298,440 | A | | 11/1981 | Hood ..... 204/165 |
| 4,347,930 | A | | 9/1982 | Herrin ..... 206/45.34 |
| 4,362,526 | A | | 12/1982 | Wilson ..... 493/226 |
| 4,385,722 | A | | 5/1983 | Brewill ..... 229/62 |
| 4,550,439 | A | | 10/1985 | Pepplatt et al. ..... 383/8 |
| 4,590,610 | A | | 5/1986 | Rhyne ..... 383/23 |
| 4,636,191 | A | | 1/1987 | Piggott ..... 493/227 |
| 4,662,974 | A | | 5/1987 | Roberts ..... 156/344 |
| 4,704,100 | A | | 11/1987 | Kaufman ..... 493/194 |
| 4,768,649 | A | * | 9/1988 | Kolton et al. ..... 206/278 |
| 4,834,553 | A | | 5/1989 | Bennett ..... 383/23 |
| 4,881,932 | A | | 11/1989 | Blatt ..... 493/213 |
| 4,919,262 | A | | 4/1990 | Kuroishi ..... 206/287.1 |
| 5,009,515 | A | | 4/1991 | Bennett ..... 383/23 |
| 5,014,957 | A | | 5/1991 | Nichol, Jr. ..... 248/340 |
| 5,026,174 | A | | 6/1991 | Blatt ..... 493/223 |
| D321,288 | S | | 11/1991 | Nichol, Jr. ..... D6/315 |
| 5,071,400 | A | | 12/1991 | Bennett ..... 493/223 |
| 5,083,413 | A | | 1/1992 | Bennett ..... 53/413 |
| 5,716,137 | A | | 2/1998 | Meyer ..... 383/75 |
| 5,894,707 | A | | 4/1999 | May ..... 53/133.7 |
| 5,944,237 | A | * | 8/1999 | Gouldson ..... 223/85 |

* cited by examiner

INTERNAL PROFILE HANGER WITH OUTWARDLY PROJECTING TAB MEMBER WITH INFORMATIONAL INDICIA THEREON

RELATED APPLICATIONS

This is a continuation-in-part of application Ser. No. 09/521,455 filed Mar. 8, 2000 now U.S. Pat. No. 6,186,934.

BACKGROUND OF THE INVENTION

1. Field of the Invention

The present invention relates to thin film plastic bags of the type having hangers which hold the bag and its contents on a supporting rod, such as found in retail display rack, and relates more particularly to an improvement in such bags wherein the hanger portion thereof has an internalized hook which connects to the supporting rod within the area of the bag defined by its side top and bottom edges to more effectively display and utilize space in a retail environment for example. In a further development, the hanger portion includes a tab member which projects beyond a leading edge of the package and defines highly visible opposed surfaces for reception thereon of informational indicia.

2. Description of the Prior Art

Plastic film bags having hangers of plastic are known in the industry. These hangers usually include a hook which protrudes outwardly and upwardly from the plastic film portion of the bag, A typical example of this technology can be found in the plastic bag construction disclosed in the U.S. Pat. No. 3,782,662 issued to Montgomery on Jan. 1, 1974. In this patent, it is disclosed to provide a plastic bag wherein a hem at the mouth of the bag is provided for receiving a stiffener portion extending transversely within the bag. The stiffener portion may have a hook which extends outwardly from the bag at the top or leading edge thereof While such hooks have been an effective way of hanging bags onto hanging rods or the like, it should be understood that the use of such hooks cause the bag to undesirably occupy vertical space otherwise dedicated to the presentation of other or more like bags on the display. This reduction in size of the bag is desirable because it increases the amount of product which can be otherwise presented to a consumer at a given display. Furthermore, the heretofore use of the outwardly extending supporting hook causes an interruption in the perimeter in the bag which from a graphic standpoint is unpleasing to the eye. That is, often the top portion of the bag will carry graphics which will be cut off or drastically interrupted by the supporting hook. U.S. Pat. No. 3,782,622 further discloses in FIG. 6 an insert has a hole 47 provided in the stiffener. This hole serves in lieu of the hook, however, the use of a hole instead of a smoothly channeled receiving slot such as found in the insert of the present invention is undesirable because it causes the user additional time in aligning the opening with the rod and inserting it concentrically over it. Specifically, it requires time to place or remove a package from a display rod and also to place it at a desired location on a display rod relative to other packages or to remove it from the display rod. This is sometimes referred to as "a shoppable package".

It has also been known to use a cardboard header insert which has a internalized recessed hook formed within the stiffener connected transversely to the top end of the bag. However, such hook structures were only found in cardboard type stiffener headers which are prone to breaking off and did not present the load capability presently needed, for example, in the package of underwear or cotton stock apparel, and hanging same on a display hook. Furthermore, in order to establish the sufficient holding strength in the header even for the limited load involved, it was necessary to size the header insert to extend transversely almost entirely across the header. This presents a further problem in that the sides of the header needed to be notched out in order to effectively seal the side edges.

SUMMARY OF THE INVENTION

The invention resides in an improved package made from thin film plastic having a hanger part formed from plastic and which hanger part has an internally profiled hook which is dimensioned so as to receive a connecting or hanging rod within the perimeter of the package making the package more compact and uninterrupted.

That is, the invention resides in a package comprising: a bag part defined by a first wall and a second wall connected along side edges thereof to define an internal compartment therein; the first and second walls further defining a header portion ending in a leading edge of the package; the leading edge of the package has a cutout extending inwardly into the header portion toward the compartment; an insert part is located within the header portion and is secured against movement to the header portion and has an opening formed therein located generally coincidentally with the cutout in the header portion; and wherein the insert is made from a rigid plastic blank and the first and second walls are made of thin film plastic material and according to which at least one of the walls may be heat welded to the insert.

More specifically, the package comprises a bag part defined by a first wall and a second wall connected along side edges thereof to define an internal compartment therein; the first and second walls further defining a header portion ending in a leading edge of the package; the leading edge of the package has a cutout extending inwardly into the header portion toward the compartment; an insert part is located within the header portion and is secured against movement to the header portion and has an opening formed therein located generally coincidentally with the cutout in the header portion; the first and second walls may be opposed separate webs of sheet material or may be portions of a single web of sheet material folded back on itself and the leading edge of the package is the folded back portion of the single web; wherein the insert is made from a rigid plastic blank and the first and second walls are made of thin film plastic material and at least one of which walls may be heat welded to the insert.

The invention also resides in a method of forming a package comprising: providing a web of thin film plastic material; folding the web of the thin film plastic material transversely of its length to create a header portion; cutting an opening in the double back web of the thin material into the folding line thereof; inserting a plastic insert with an internally formed opening between the doubled back web pieces; and securing the insert against movement in the header portion.

In another embodiment of the invention, the hanger portion includes a tab member which projects beyond a leading edge of the package and defines highly visible opposed surfaces for reception thereon of informational indicia, sizing, for example. With this construction, packaged apparel in a plastic film bag with a sizing hanger will be consistent with the hanging of apparel without using a plastic film bag which has sizing information already on supporting hangers. Additionally, a customer can easily see the size of a garment whether viewing from in front of the package or from behind the package. Also, the customer can remove the product from either the front or the rear. A retailer can even place different sized garments on the same rack since the different sizes can readily be seen by a customer. Further, using this embodiment of the invention, a manufacturer need not print size information on an enclosing bag but can use plain bags since that information is already provided on the tabbed hanger portion. This is also beneficial in that costly steps of a printing press to print different sizes is no longer necessary.

Accordingly, it is a feature of the invention to provide an improved plastic bag with a hanger incorporated therein having a construction which provides a low cost and effective bag having a hanger which does not extend beyond the outline of the bag thereby providing the bag with a reduced effective height and uninterrupted face. Still a further feature of the invention is to provide an improved package made of plastic film or the like having an associated hanger made from plastic or the like which may be heat welded with the film thereby enabling the package to be compact and self-contained.

Still a further feature of the invention is to provide an improved package of the aforementioned type having an internalized hanger which provides a fixed and unvarying relationship between packages of like fabrication.

Still a further feature of the invention is to provide an improved method of assembling a hanger within a thin film package.

Still yet a further feature of the invention is to provide a package which provides high strength and allows the package to be printed on up to its leading edge.

Yet another feature of the invention is to provide a hanger portion which includes a tab member which projects beyond a leading edge of the package and defines highly visible opposed surfaces for reception thereon of informational indicia.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts throughout the disclosure.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
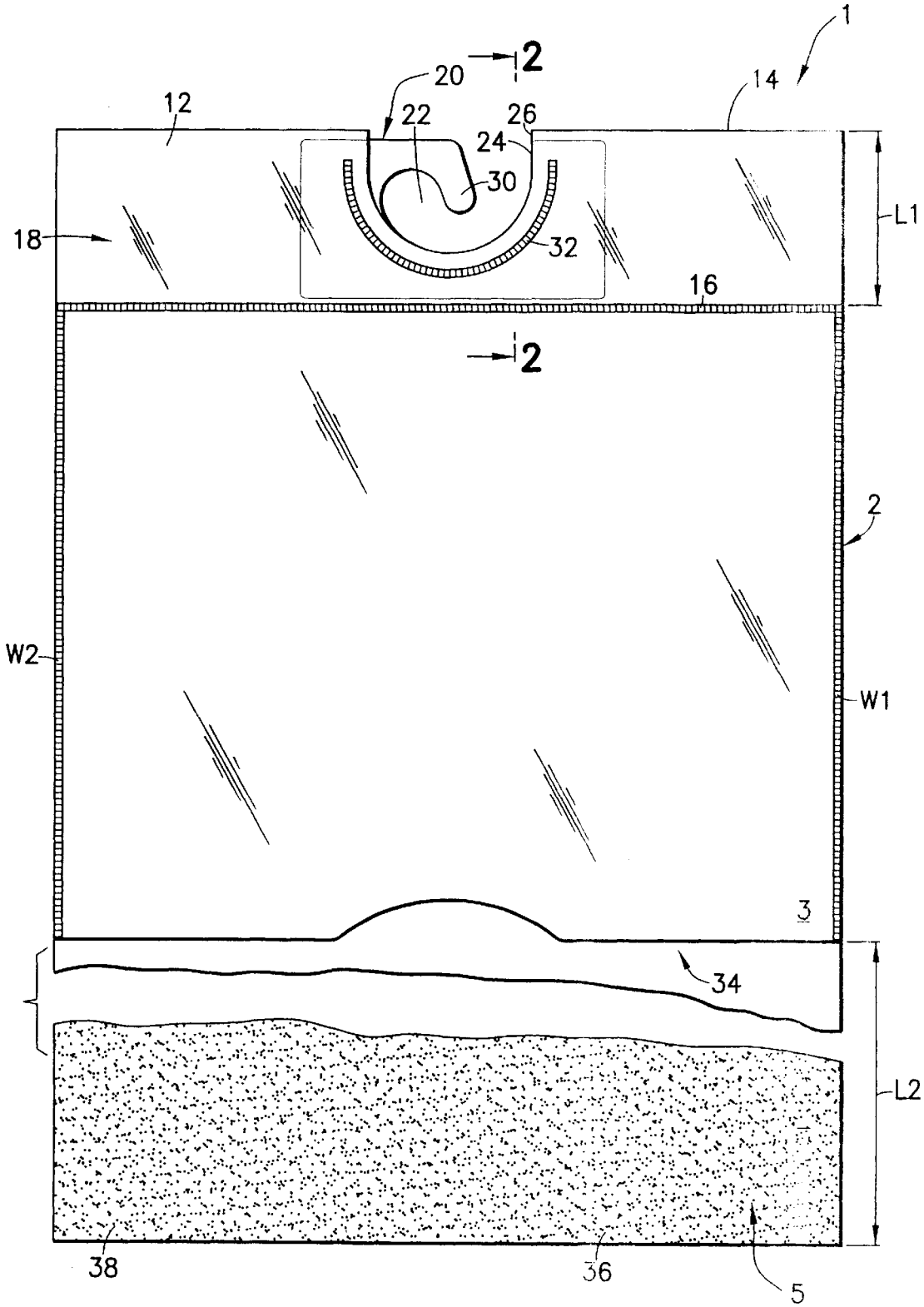
FIG. 1 is a partially fragmentary plan view of the package of the present invention.

FIG. 1 shows generally a package indicated by reference numeral 1 embodying the present invention. The package 1 has a bag part 2 and a hanger part 20, the bag part is made from thin film flexible heat sealable sheet material, such as polyethylene or polypropylene, having front and back walls 3, 5 joined at the side edges thereof by a heat seal weld respectively shown for each side as W1 and W2 of the bag part 2. As seen in FIG. 1, the package 1 has at the topmost end, a leading edge 14 which is defined by a doubled back length of the thin film bag material. This leading edge further defines in part a header portion 18 having an internal laterally extending pocket 12. That is, the pocket 12 at its topmost end is formed by the doubled back length of the flexible heat sealable sheet material, and at a distance L1 is further defined by a laterally extending heat weld 16 which extends laterally across the transverse face of each of the front and back walls 3 and 5 and meets with the side edge welds W1 and W2. Thus, between the top double backed leading edge 14 and a transverse weld 16, a header portion 18 is defined. The header portion 18 is correspondingly sized and shaped to receive the generally rectangular shape of the hanger part 20, or insert, therein. The hanger part 20 is formed from rigid flat plastic piece and has a generally J-shaped slot 22 formed in it opening to a semi-circular cutout 24 cut through both plies of the material and opening to the leading edge 14 at the top edge thereof The insert is preferably of the same color as the graphic printed on the header portion 18 to better blend with it.

As will be discussed in greater detail later, the J-shaped slot 22 in the hanger part 20 is designed so as to readily receive a rack rod which would be found normally in a display environment in a retail establishment such that the package can be readily hung on the rod and be taken off of the rack rod by a simple manipulation or movement. The J-shaped slot 22 is located coincidentally with the generally semi-circular cutout 24 which is cut into the two front and back walls 3 and 5 of the bag part 2. As mentioned, the cutout 24 also permeates the double back leading edge 14 thereby exposing the middle band of the pocket 12 to the internally disposed hanger part 20 located within the pocket 12.

As illustrated, the cutout 24 has a generally semi-circular form as illustrated such that the bottom arc of the cutout 24 is coincident with the curvature of the bottom of the J-shaped slot thereby minimally exposing the hanger part. This is important in that it maintains as much as possible a non-interrupted face in the top portion of the bag part so as to give a greater continuing appearance to it.

As illustrated, the hanger part 20 has a hook portion 30 which is defined by the J-shaped slot 22 and extends into the cutout 24 made in the bag material in the manner illustrated. The hook portion 30 is preferably of the same color as that of the header portion 18 of the package 1, which usually contains graphics and logos concerning the product and/or its manufacturer. Thus, the interruption in color caused by the cutout 24 in the header portion 18 may be minimized by a similarly coloring the hook portion 30 with that of the header portion color.

Figures 1A, 1B, 2:
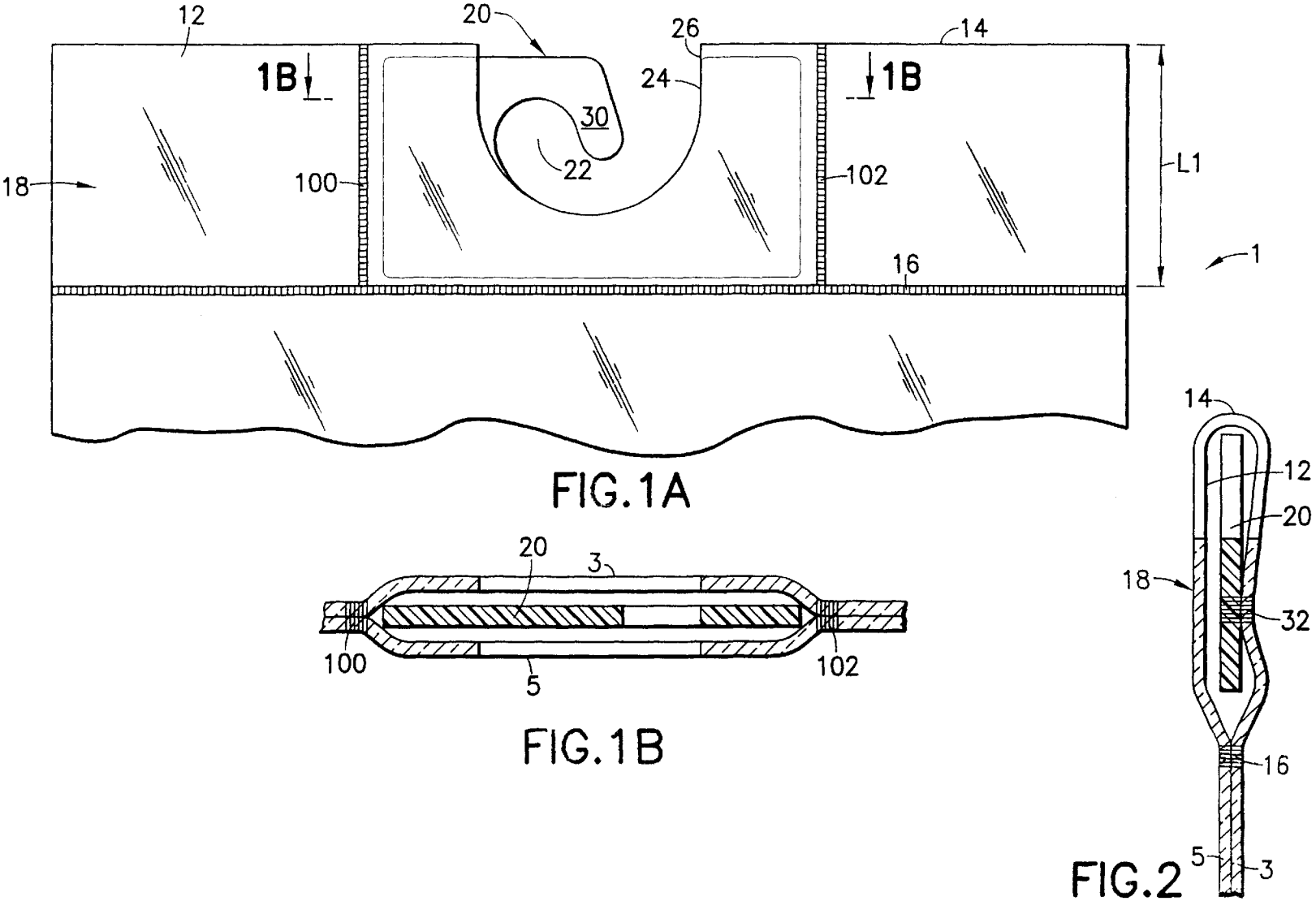
FIG. 1A is a detail plan view, similar to a part of FIG. 1, illustrating another embodiment of the invention.
FIG. 1B is a detail cross section view taken generally along line 1B—1B in FIG. 1A.
FIG. 2 is a partially fragmentary vertical elevation view taken along line 2—2 in FIG. 1.

As illustrated in FIG. 1 and in FIG. 2, the hanger part 20 is maintained within the pocket 12 in the position illustrated in FIG. 1 through the intermediary of a heat weld 32, preferably arcuate, which is formed between one or both of the front and rear walls 3 and 5 and the hanger part 20. The heat weld 32 may be made directly into the hanger part 20 thereby holding and fixing the position of the hanger part relative to the bag part. This maintains the relative position of the hanger part and the bag part without need of mechanical or other fastenings or other like positioning means.

In another instance, viewing FIG. 1A, the front and back walls 3, 5 may be mutually heat welded as at 100, 102 which, together with heat weld 16, form a pocket 104 snugly containing the hanger part 20 and restraining it against substantial movement. This may desirably eliminate the need for the heat weld 32 illustrated in FIGS. 1 and 2.

As illustrated in FIG. 1, the back wall 5 has a length which exceeds that of the front wall 3 by the dimension illustrated as L2. This length L2 is provided such that an opening 34 exists between the walls 3 and 5 thereby allowing product to be stuffed within a pocket formed by the side welds W1, W2 and a transversely extending weld 16. As is typical in the industry, the end portion of a flap 36 may have a film of releasable adhesive 38 allowing the flap to be upturned and sealed into place onto the outer surface of the front wall 3 upon stuffing of the product into the pocket.

Figure 4:
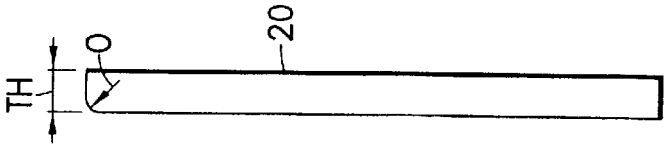
FIG. 4 is a side elevation view of the hanger of FIG. 3.
Figure 3:
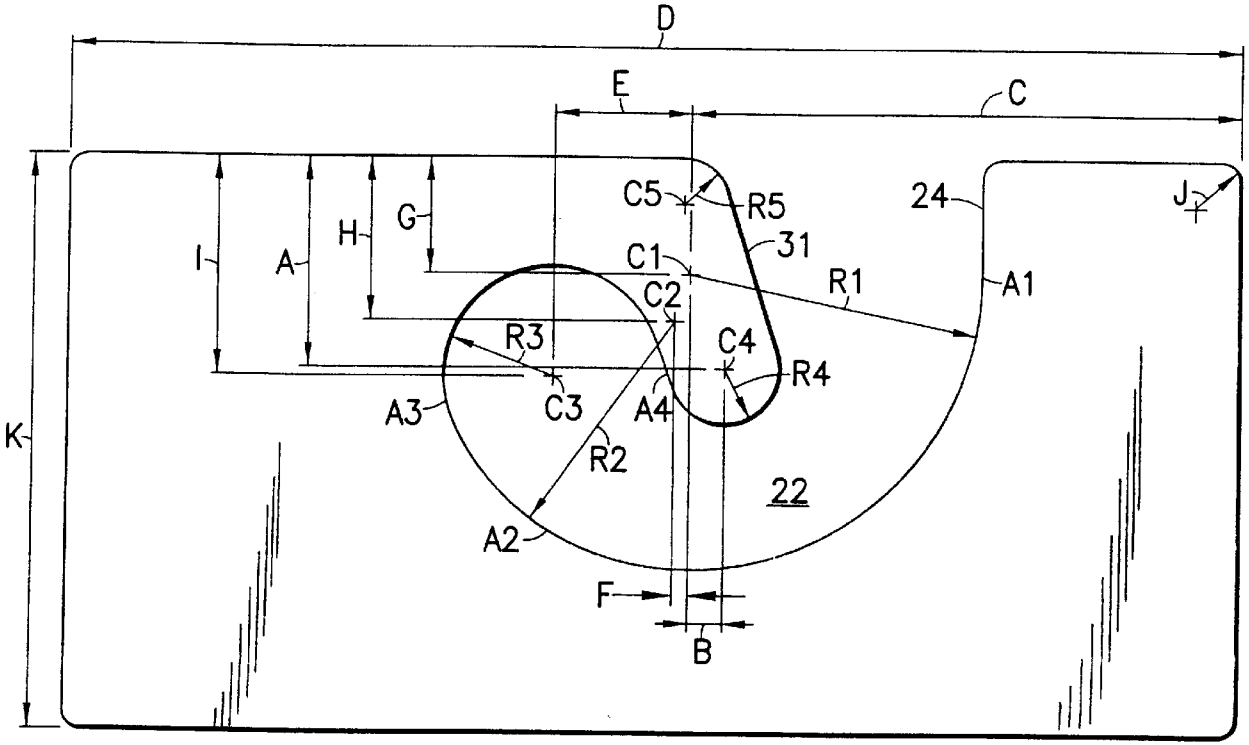
FIG. 3 is a top plan view showing the hanger apart from the bag.

Referring now to FIGS. 3 and 4, it should be seen that the hanger part 20 has an internally formed J-shaped slot 22 with the semi-circular cutout 24 opening coincidentally with the top leading edge 14 of the bag part. The semi-circular cutout 24 is designed to facilitate easy guidance onto a rack rod which may have a nominal diameter on the order of 0.250 inches, or thereabouts, depending on the application. In any event, the J-shaped slot 22 is designed such that regardless of the diameter of the mounting rod used, ease of hanging of the bag part and subsequent removal can be effected by both the stocker and the customer, respectively.

To these ends, it should be seen that from a review of the slot 22 formed in the hanger part 20 that along given points the shape of the arc changes to accommodate various functions involved in the use of the hanger part. That is, along the segment from point A1 to point A2, the J-shaped slot 22 has a generally constant first radius R1 equaling approximately 0.515 inches taken from the theoretical center C1. At point A2, a second curvature is provided between points A2 and points A3 which is equal to a second radius of 0.437 inches taken from the theoretical center C2. Between points A3 and A4 is a third radius R3 taken from the theoretical center C3 having a radius of 0.195 inch. This radius provides an enlarged receiving area for the rack rod to support the bag part and be removed without jamming. The radius R3 ends at point A4 and another, fourth, radius R4 having a theoretical center at C4 is provided to define the tip of the hanger part wherein a straight line 31 (FIG. 3) angled upwardly at approximately 18° to the vertical is made. The angular cut along with a fifth radius R5 of 0.062 inch measured from theoretical center C5 defines the semi-circular cutout 24 and allows for insertion of the bag part into place. The insert also has a thickness TH of approximately 0.063 inches allowing it to provide sufficient thickness to receive and hold the weld 14 and to support between 12 and 14 ounces of product which can range from socks to underwear. The below table illustrates further dimensions which are not otherwise taken into discussion.

Dimensions are all in inches

A=0.369
B=0.058
C=0.993
D=2.125
E=0.25
F=0.028
G=0.200
H=0.278
I=0.375
J=0.031
K=1.00
L=0.406
M=0.031
N=0.437
O=0.016

Figure 5A:
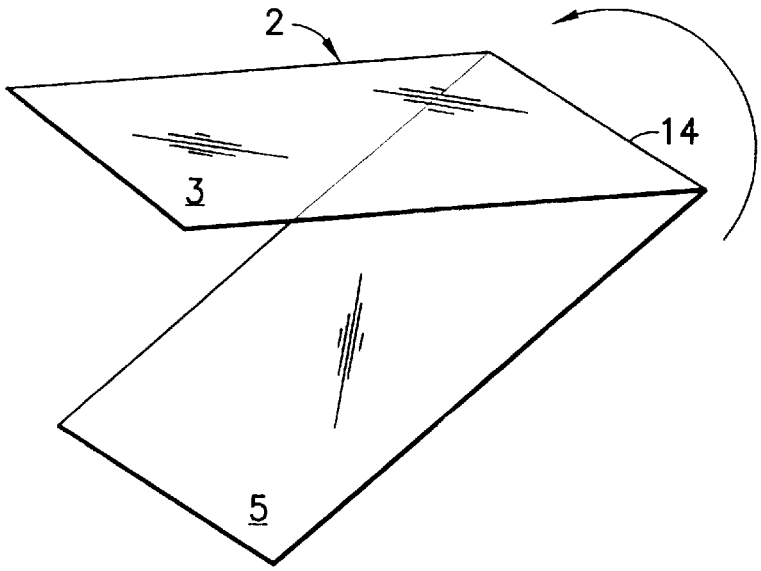
FIGS. 5A–5D show schematically the fabrication process for the bag of FIG. 1.
Figure 5B:
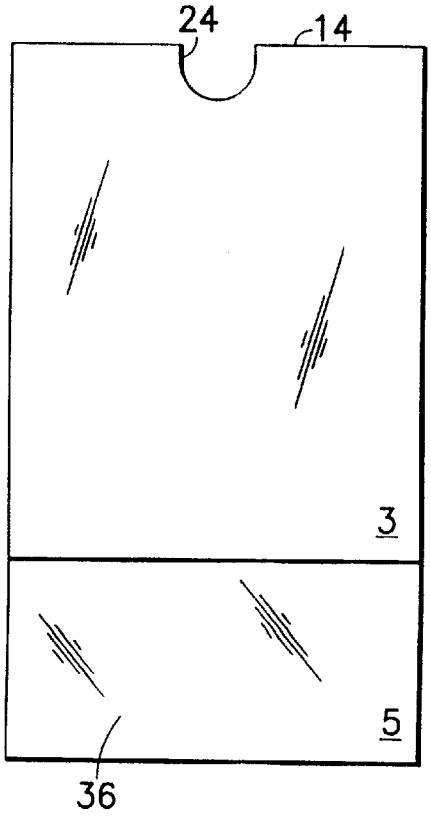
Figure 5D:
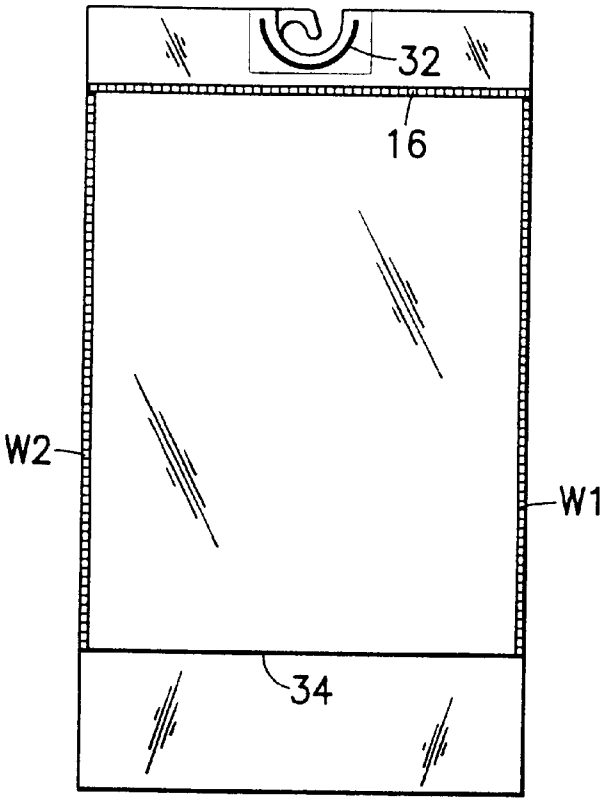
Figure 5C:
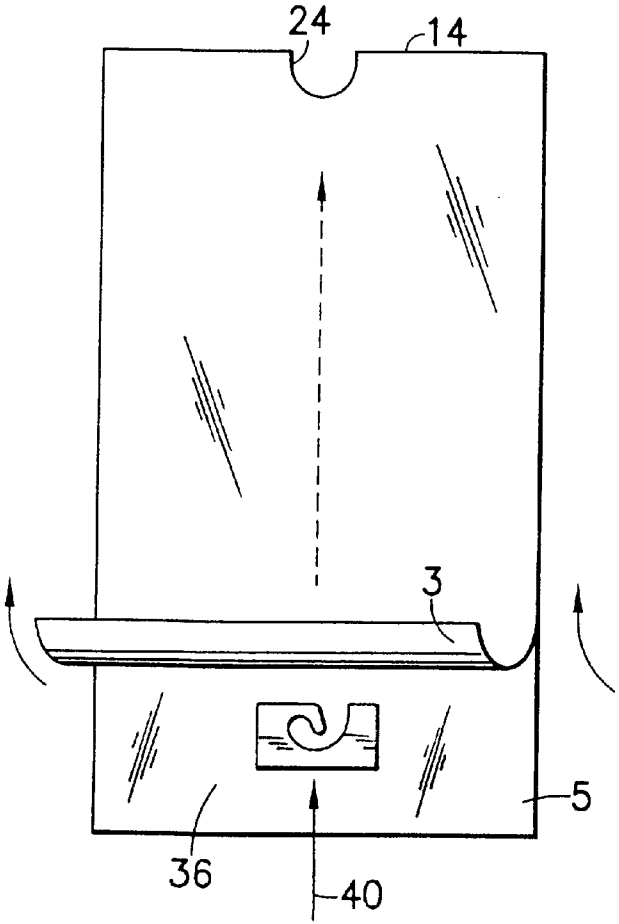
Figure 6A:
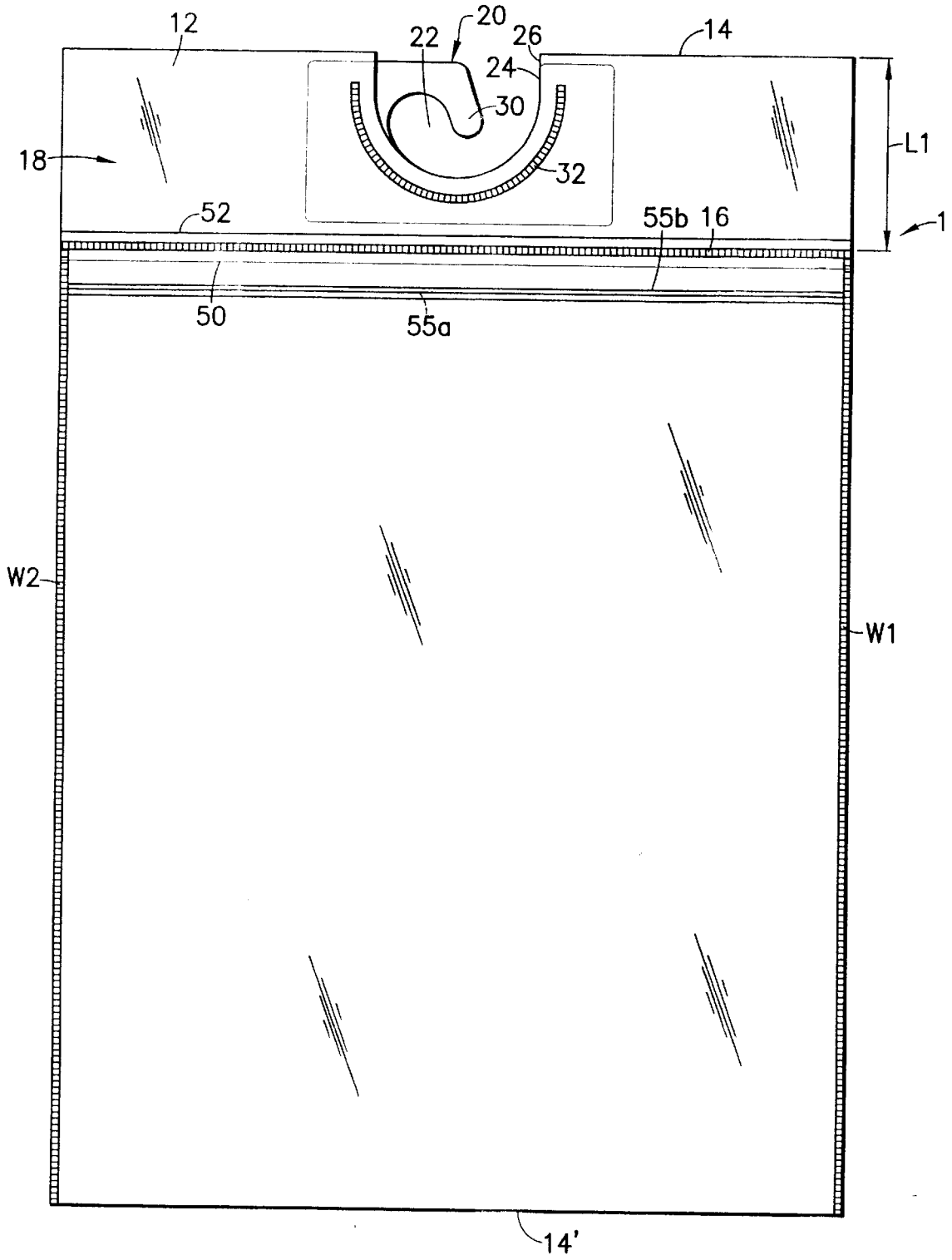
FIGS. 6A–6D show an alternative embodiment and show schematically the fabrication process for the bag of FIG. 6A.
Figure 6B:
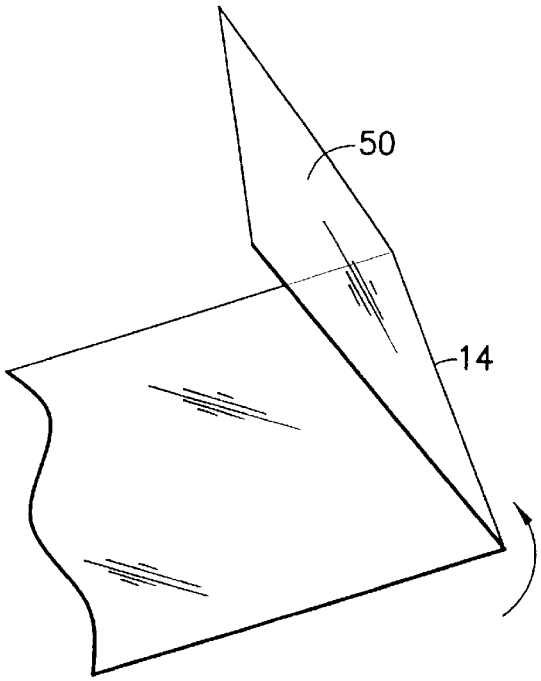
Figure 6C:
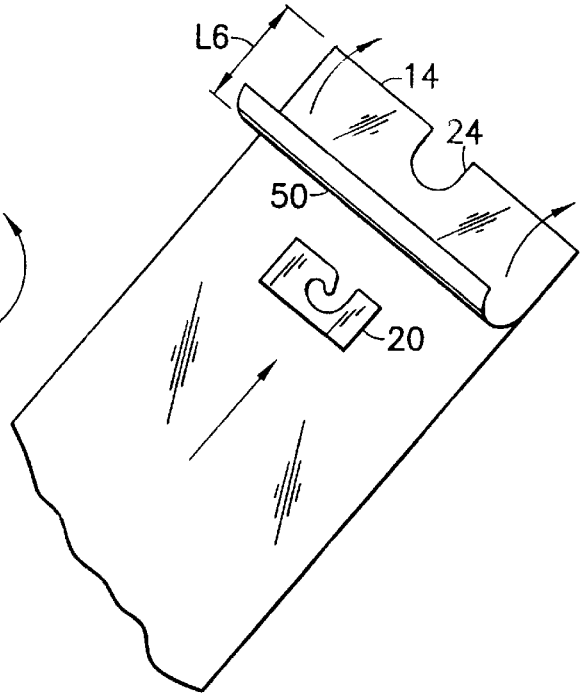
Figure 6D:
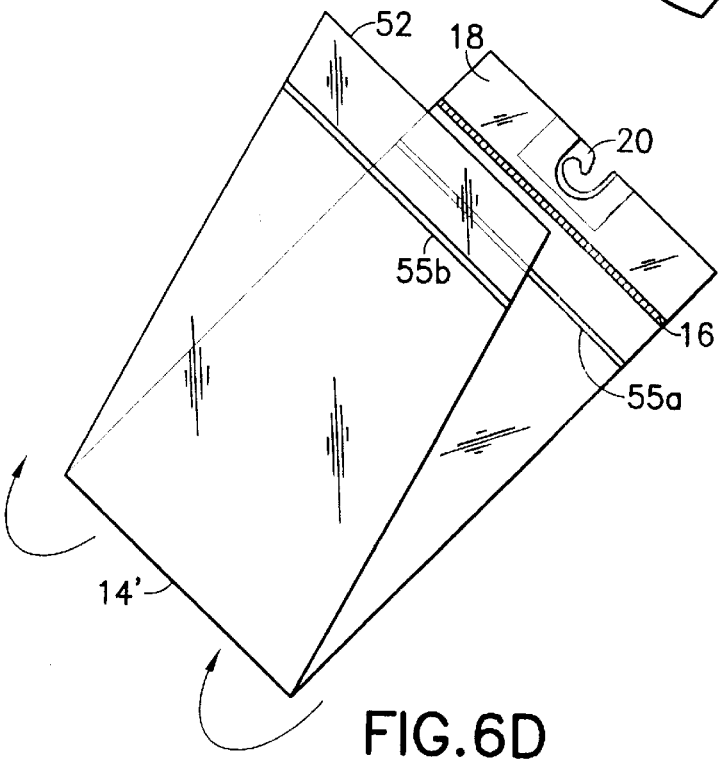
Figure 7A:
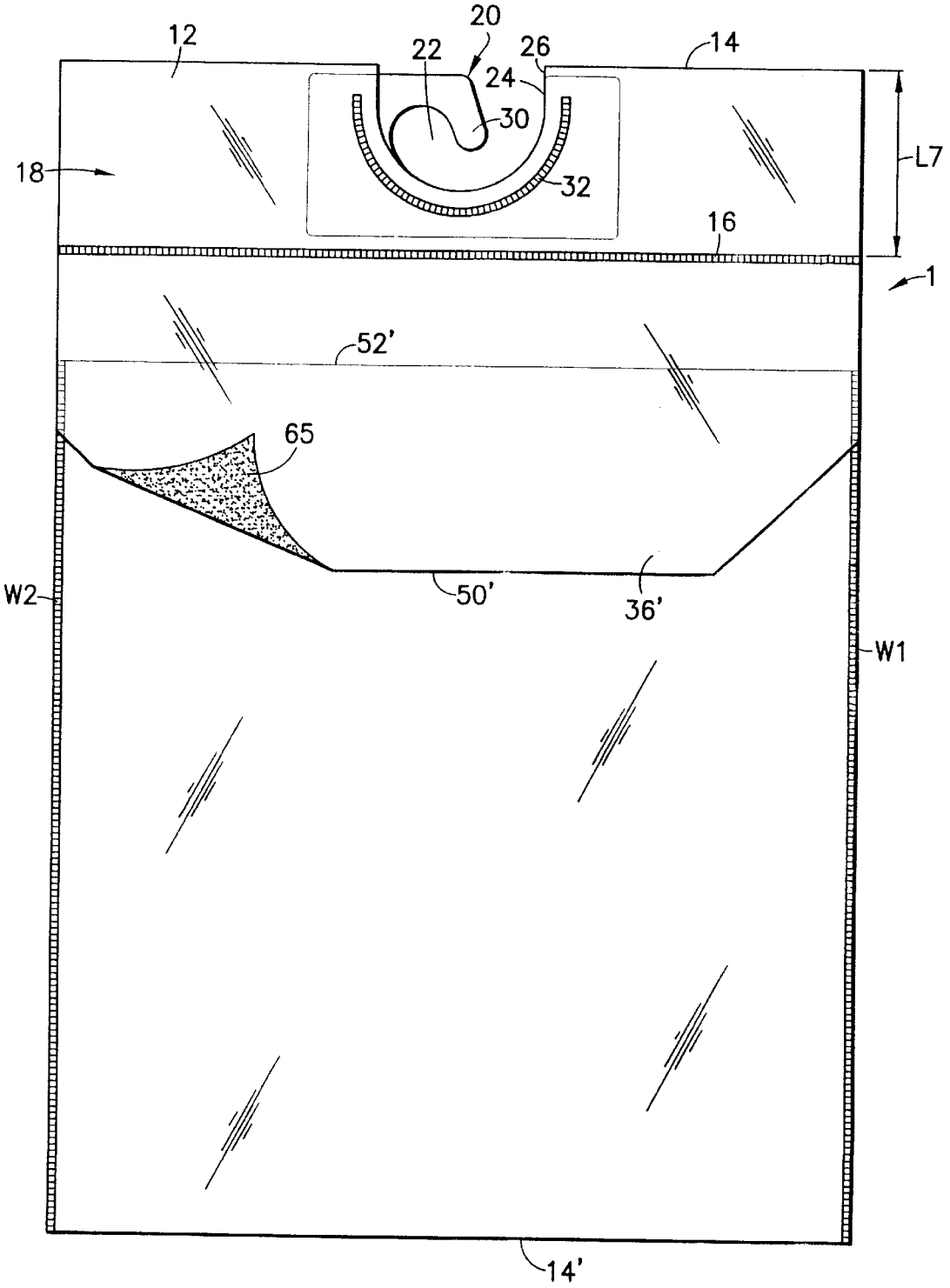
FIGS. 7A–7D show an alternative embodiment and show schematically the fabrication process for the bag of FIG. 7A.
Figure 7B:
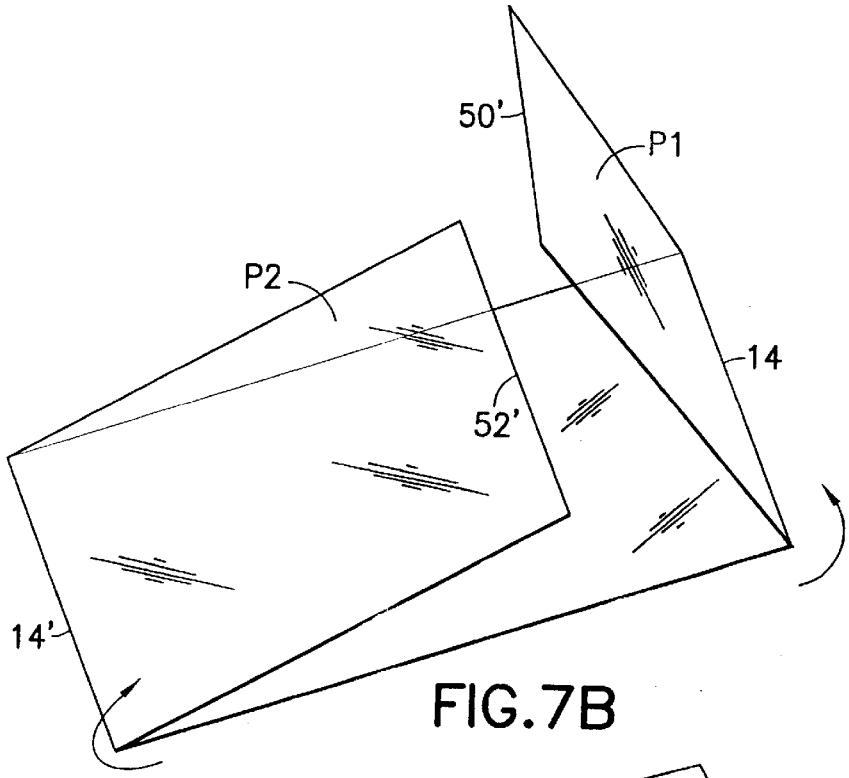
Figure 7C:
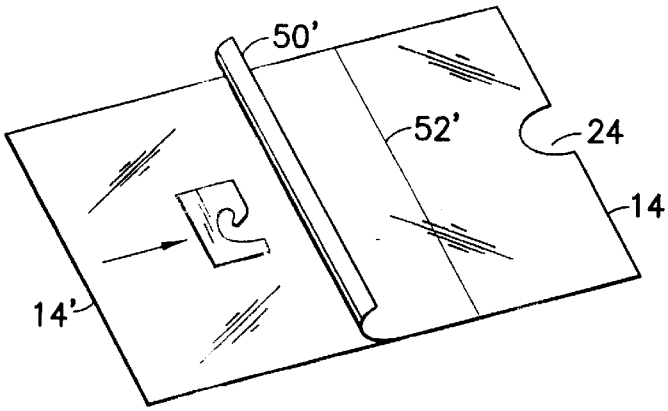
Figure 7D:
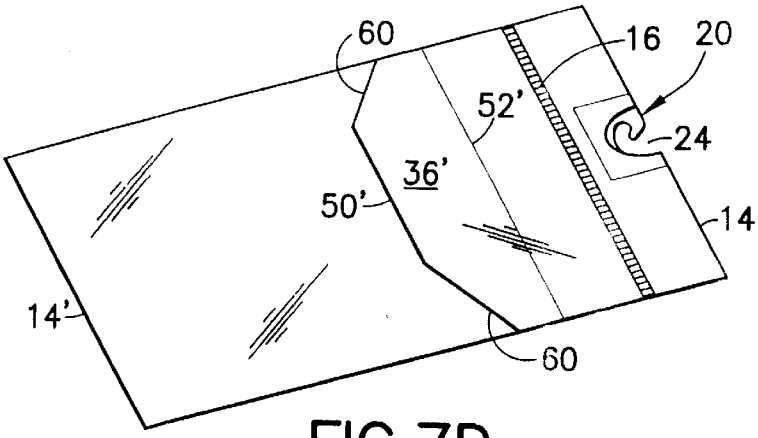

Referring now to FIGS. 5A–5C, the method by which the package 1 illustrated in FIG. 1 is made is shown. As seen in FIG. 5A, a single sheet web of thin film plastic material is folded along itself along a transverse fold line at the leading edge 14. The fold line at the leading edge 14 also defines the front and back walls 3 and 5, respectively, of the bag part 2 with the length of the front wall 3 being selected to be shorter than back wall 5 by the length L2 (see FIG. 1), such that the dimension L2 provides the flap 36 herein discussed above.

After the fold line 14 is made, the semi-circular cutout 24 is formed through the leading edge 14 proximate the center of the bag part. Thereafter, the two plies are separated from one another enough to allow the hanger part 20 to be slid upwardly toward the leading edge 14 in the direction indicated by arrow 40 so as to position it in the location shown in FIG. 1, that is, such that the generally J-shaped slot is lined up coincidentally with the cutout 24 and the bottom curvatures of both the slot and the cutout are aligned with one another as seen in FIG. 1.

With the hanger part 20 in place, welds are made on the film material. Weld 16 is provided transversely along the top portion of the bag part as mentioned and welds W1 and W2 are made along the longitudinal edges thereof. Either before or after these welds are in place or in combination therewith, the connecting weld 32 may be made between one or both the walls 3 and 5 of the film material to immovably connect the bag part 2 to the hanger part 20.

Referring now to FIGS. 6A–6D, a second embodiment of the invention is shown. In this embodiment, a single sheet of web has upper and lower leading edges 14, 14', the upper portion of which forms the header portion 18 and connects the hanger part 20 to the package 1 in a manner similar to that discussed above with respect to FIGS. 5A–5D. That is, the leading edge 14 of the package 1 is formed by a fold line which in turn forms the pocket 18 by the doubled back portion of the sheet material. In the present embodiment, the doubled back portion identified by the dimension L1 is cut to form a free end 50 which is sealed to the opposing sheet by the transverse weld 16. Since the bottom of the bag part is dosed at the other fold line 14', only welds W1 and W2 need be made in order to effect the bag compartment. The opposite free end 52 of the sheet material forming the bag pocket is without a weld, but is provided with a releasable sealing device, such as a zip lock type seal 55*a*, 55*b* each of which part is welded to one of the free end 52 portion and the opposite surface of the sheet material.

Referring now to FIGS. 7A–7D, a third embodiment of the invention is shown. In this embodiment, a single sheet has upper and lower leading edges 14, 14', the upper portion of which forms the header portion 18 and connects the hanger part 20 to the package 1 in a manner similar to that discussed above with respect to FIGS. 5A–C. That is, the leading edge 14 of the package 1 is formed by a fold line which in turn forms the pocket 18 by the doubled back portion of the sheet material. In the present embodiment, the doubled back portion identified by the dimension L7 is cut to form a free end 50' which is sealed to the opposing sheet by the transverse weld 16. The leading edge 14' creates a panel portion P2 over which is folded panel portion P1 created by a fold line 14 defined by the leading edge 14. The panel P1 is of a length that it extends beyond the transverse weld 16 and is cut at 60 so as to create a flap which is subsequently cut to create the flap 36'. Since the bottom of the bag part is closed by the other fold line defined by the leading edge 14', only welds W1 and W2 need be made in order to effect the bag compartment. The opposite free end 52 of the sheet material forming the bag pocket is without a weld, and the flap 36' may be adhesively attached to it at 65.

Figure 8B:
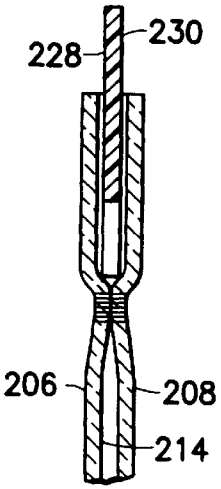
FIG. 8B is a detail cross section view taken generally along line 8B—8B in FIG. 8A.
Figure 8A:
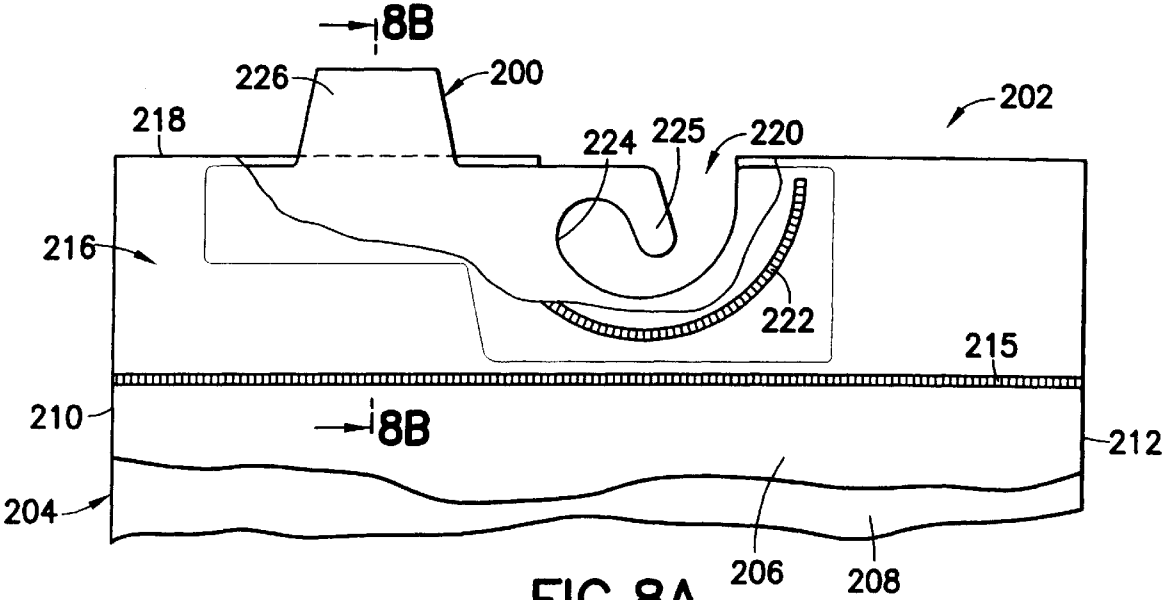
FIG. 8A is a detail plan view, similar to FIG. 1A, illustrating another embodiment of the invention.
Figure 8C:
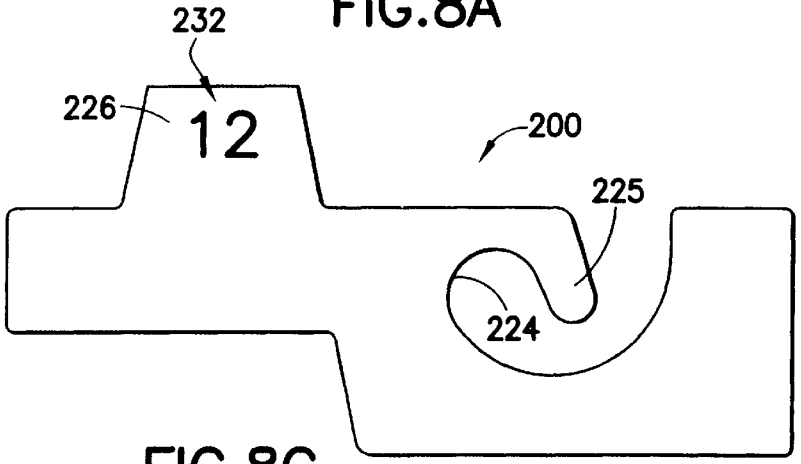
FIG. 8C is a top plan view showing the modified hanger part apart from the bag.

Turn now to FIGS. 8A, 8B, and 8C for the description of still another embodiment of the invention. In this instance, a modified hanger part 200, or insert, is provided. As in the earlier embodiments, a modified package 202 includes a bag part 204 of thin film plastic material defined by a first wall 206 and a second wall 208 connected along side edges 210, 212, respectively, to define an internal compartment 214 therein. Again, the first and second walls 206, 208 further define a header portion 216 ending in a leading edge 218 of the package 202. The leading edge 218 of the package 202 has a cutout 220 extending inwardly into the header portion 216 toward the internal compartment 214.

The modified hanger part 200, or internal profile insert, is composed of substantially rigid material located within the header portion 216 and secured against movement to the header portion as by a heat weld 222 or by heat welds 100, 102 as illustrated in the embodiment of FIG. 1A. As with the hanger part 20, the modified hanger part 200 has an internalized J-shaped slot 224 opening to the leading edge 218 and defining a hook portion 225. The J-shaped slot 224 is located generally coincidentally with the cutout 220 in the header portion 216. The internal profile insert 200 further includes a tab member 226 laterally offset with respect to the J-shaped slot 224 which projects beyond the leading edge 218 of the package 202 and defines opposed surfaces 228, 230 (FIG. 8B). The opposed surfaces 228, 230 can be imprinted with informational indicia 232 such as sizing information relating to the garment contained in the package 202 as seen in FIG. 8C.

As earlier mentioned, with this construction, packaged apparel in a plastic film bag with a sizing hanger will be consistent with the situation of apparel hung without using a plastic film bag but which has sizing information already on supporting hangers. Additionally, with this embodiment of the invention, a customer can easily see the size of a garment whether viewing a series of garments from the front or from the rear. Also, the invention enables a customer to remove the product from either the front or the rear. With the invention, a retailer can even place different sized garments on the same rack since the different sizes can readily be seen by a customer. Further, using this embodiment of the invention, a manufacturer need not print size information on an enclosing bag but can use plain bags since that information is already provided on the tabbed hanger portion. Further, this construction is beneficial in that costly steps of a printing press to print different sizes is no longer necessary.

It should be understood that the foregoing description is only illustrative of the invention. Various alternatives and modifications can be devised by those skilled in the art without departing from the invention. The hanger part 20 need not be welded directly to the web or film wall(s), but rather the two plies making up the harder portion could themselves be weld together around the insert to secure it against movement therein. Accordingly, the present invention is intended to embrace all such alternatives, modifications and variances which fall within the scope of the appended claims.

What is claimed is:

1. A package comprising:

a bag part of thin film plastic material defined by a first wall and a second wall connected along side edges thereof to define an internal compartment therein;

the first and second walls further defining a header portion ending in a leading edge of the package;

the leading edge of the package having a cutout extending inwardly into the header portion toward the compartment;

an internal profile insert of substantially rigid material located within the header portion and secured against movement to the header portion and having an internalized J-shaped slot opening to the leading edge and being located generally coincidentally with the cutout in the header portion, the internal profile insert including a tab member which projects beyond the leading edge of the package and defines opposed surfaces for reception thereon of informational indicia.

2. A package as defined in claim 1 wherein at least one of the first and second walls is welded to the insert.

3. A package as defined in claim 1 wherein the first and second walls are mutually welded to form a pocket snugly containing the insert and restraining it against substantial movement.

4. A package as defined in claim 1 further characterized by the first and second walls being further connected together along a transversely extending line spaced from the leading edge and forming a header portion of the package.

5. A package as defined in claim 1 further characterized by the insert being heat welded to the one of the first and second walls.

6. A package as defined in claim 5 further characterized by the header portion being formed from a single web of sheet material folded back on itself and having a transverse weld formed thereacross.

7. A package as defined in claim 6 further characterized by the single web sheet defines at least one of the first and second walls.

8. A package as defined in claim 6 further characterized by the leading edge of the package being the folded back portion of the single web.

9. A package as defined in claim 1 characterized by the first wall and the second wall being opposed separate webs heat welded along the side edges to define the internal compartment.

10. A package as defined in claim 1 further characterized by the insert having a dimension extending transversely of the package which is substantially less than a like dimension of the header portion taken as between two side edges of the walls.

11. A package as defined in claim 10 further characterized by the substantially J-shape slot has a first radius of curvature positioned generally coincidentally with a radius curvature of the cut formed in the bag.

12. A package as defined in claim 11 further characterized by the generally J-shaped slot having a second radius of curvature greater than the first radius of curvature providing a recess for hanging a rack rod thereon.

13. A package as defined in claim 12 further characterized by the tab member having graphics printed thereon between the leading edge and the transverse weld and wherein the insert is made in the color of the graphic printed on the tab member.

14. A package comprising:

a bag part defined by a first wall and a second wall connected along side edges thereof to define an internal compartment therein;

the first and second walls further defining a header portion ending in a leading edge of the package;

the leading edge of the package having a cut extending inwardly into the header portion toward the compartment;

an internal profile insert part located within the header portion and secured against movement to the header portion and having a J-shape lot formed therein located generally coincidentally with the cut in the header portion;

the header portion being formed from a single web of sheet material folded back on itself and the leading edge of the package being the folded back portion of the single web;

wherein one of the first and second walls being defined by the single web of sheet material and the insert being made from a substantially rigid blank and the first and second walls being of thin film sheet material.

15. A package as defined in claim 14 wherein at least one of the walls is heat welded to the insert.

16. A package as defined in claim 14 further characterized by the opening in the insert J-shaped slot configuration opening to the leading edge of the bag.

17. A package as defined in claim 14 further characterized by the first and second walls being further connected together along a transversely extending line spaced from the leading edge and forming a header portion of the package.

18. A package as defined in claim 13 further characterized by the insert having a dimension extending transversely of the package which is substantially less than a like dimension of the header portion taken as between two side edges of the walls.

* * * * *